US010405076B2

(12) United States Patent
Concorso

(10) Patent No.: US 10,405,076 B2
(45) Date of Patent: Sep. 3, 2019

(54) ELIMINATION OF PARASITIC AUDIO VIBRATIONS USING SPRING MOUNTED SPEAKERS

(71) Applicant: James A. Concorso, Cliffside Park, NJ (US)

(72) Inventor: James A. Concorso, Cliffside Park, NJ (US)

( * ) Notice: Subject to any disclaimer, the term of this patent is extended or adjusted under 35 U.S.C. 154(b) by 77 days.

(21) Appl. No.: 15/812,474

(22) Filed: Nov. 14, 2017

(65) Prior Publication Data

US 2018/0070160 A1 Mar. 8, 2018

(51) Int. Cl.
*H04R 1/02* (2006.01)
*H04R 9/02* (2006.01)
*H04R 9/06* (2006.01)

(52) U.S. Cl.
CPC ..... *H04R 1/026* (2013.01); *H04R 1/021* (2013.01); *H04R 1/025* (2013.01); *H04R 9/02* (2013.01); *H04R 9/06* (2013.01); *H04R 2201/025* (2013.01); *H04R 2201/028* (2013.01)

(58) Field of Classification Search
CPC ..... H04R 1/26; H04R 1/026; H04R 1/403; H04R 1/02; H04R 1/025; H04R 5/02; H04R 1/227; H04R 1/2811; H04R 1/2819; H04R 1/2842; H04R 1/2888; G11B 3/60; G11B 19/00; G11B 25/04; G11B 33/027; G11B 33/122; G11B 33/124; G11B 3/40; G11B 11/20; G11B 17/00; G11B 17/04; G11B 17/0408; G11B 17/12; G11B 19/08; G11B 19/165; G11B 19/2009; G11B 19/2018; G11B 20/02; G11B 21/006
USPC ..... 381/345, 335, 386, 395, 182, 308, 337; 181/160, 144, 152, 163, 171, 172; D14/203, 163, 168, 188, 199, 49
See application file for complete search history.

(56) References Cited

U.S. PATENT DOCUMENTS

| | | | | |
|---|---|---|---|---|
| 2,325,807 A | | 8/1943 | Stephan | |
| 2,516,353 A | * | 7/1950 | Strauss | G11B 33/06 369/64 |
| 2,775,309 A | | 12/1956 | Villchur | |
| 3,300,222 A | | 1/1967 | Scott | |
| 3,342,498 A | | 9/1967 | Eberhardt | |
| 4,079,944 A | * | 3/1978 | Durley, III | G11B 3/0957 369/142 |
| 4,251,045 A | | 2/1981 | Meyerle | |
| 5,532,993 A | * | 7/1996 | Yanagisawa | G11B 33/08 360/99.15 |
| 6,485,241 B1 | | 11/2002 | Oxford | |

(Continued)

*Primary Examiner* — Curtis A Kuntz
*Assistant Examiner* — Julie X Dang
(74) *Attorney, Agent, or Firm* — Stanley H. Kremen

(57) ABSTRACT

The Present Invention is for a speaker system both standalone and in a phonograph that greatly reduces sympathetic vibration and feedback due to interaction of sound vibration transmitted from bass speakers to the chassis. The solution is twofold. First, the speakers are mounted in a substantially airtight enclosure. Second, the substantially airtight enclosure is suspended within the sound system chassis using elastic members in tension. A typical elastic member is an extension spring. In a phonograph, the elastic suspension almost completely isolates vibrations of the speaker enclosure from the phonograph chassis, thereby drastically reducing sympathetic vibration and feedback, and accommodating new depths of bass extension.

29 Claims, 5 Drawing Sheets

(56) References Cited

U.S. PATENT DOCUMENTS

| | | | | |
|---|---|---|---|---|
| 6,829,807 | B2 * | 12/2004 | Kim | G06F 1/1616 16/319 |
| 7,740,247 | B2 | 6/2010 | McRay et al. | |
| 8,630,428 | B2 | 1/2014 | Castro et al. | |
| 8,837,763 | B1 * | 9/2014 | Millen | H04R 1/2834 181/145 |
| 9,473,853 | B2 | 10/2016 | Huang | |
| 2008/0144478 | A1 * | 6/2008 | Frederick | G11B 3/64 369/264 |
| 2014/0369546 | A1 | 12/2014 | Huang | |

* cited by examiner

FIG. 2B
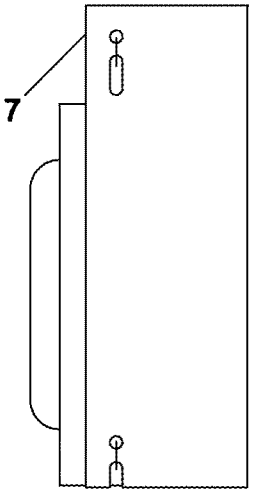
FIG. 2A
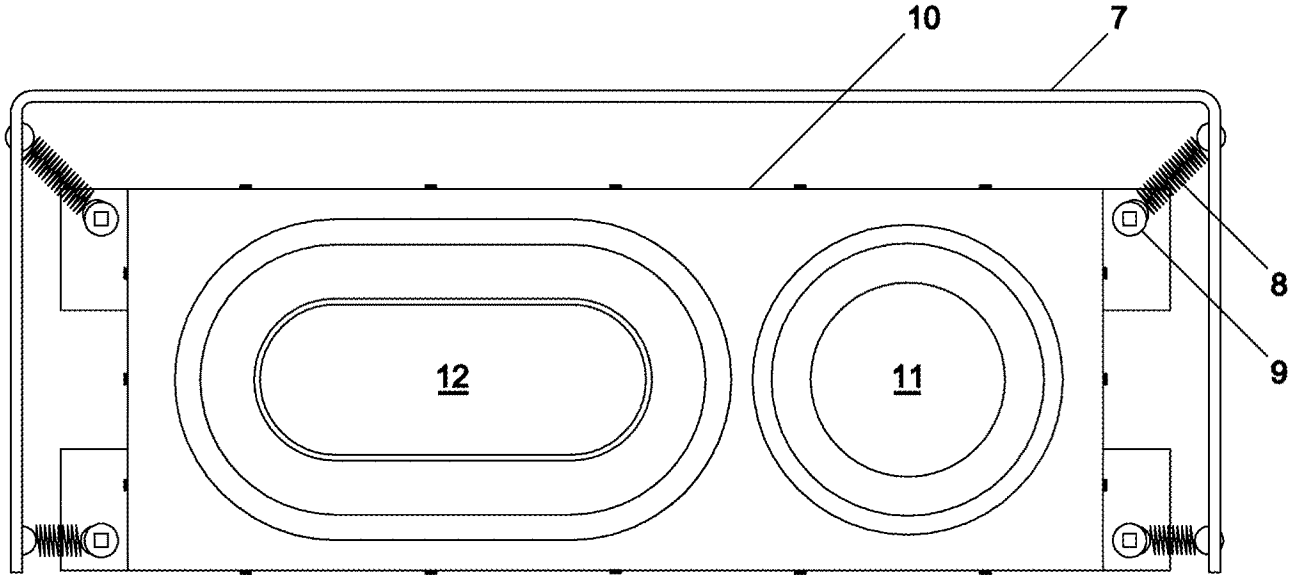
FIG. 2

FIG. 3B
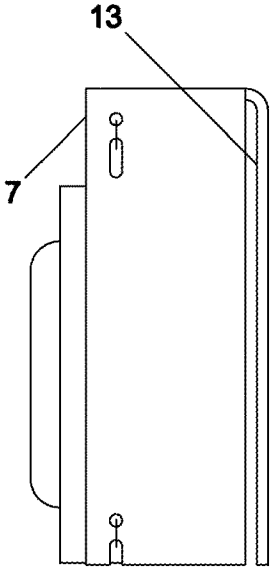
FIG. 3A
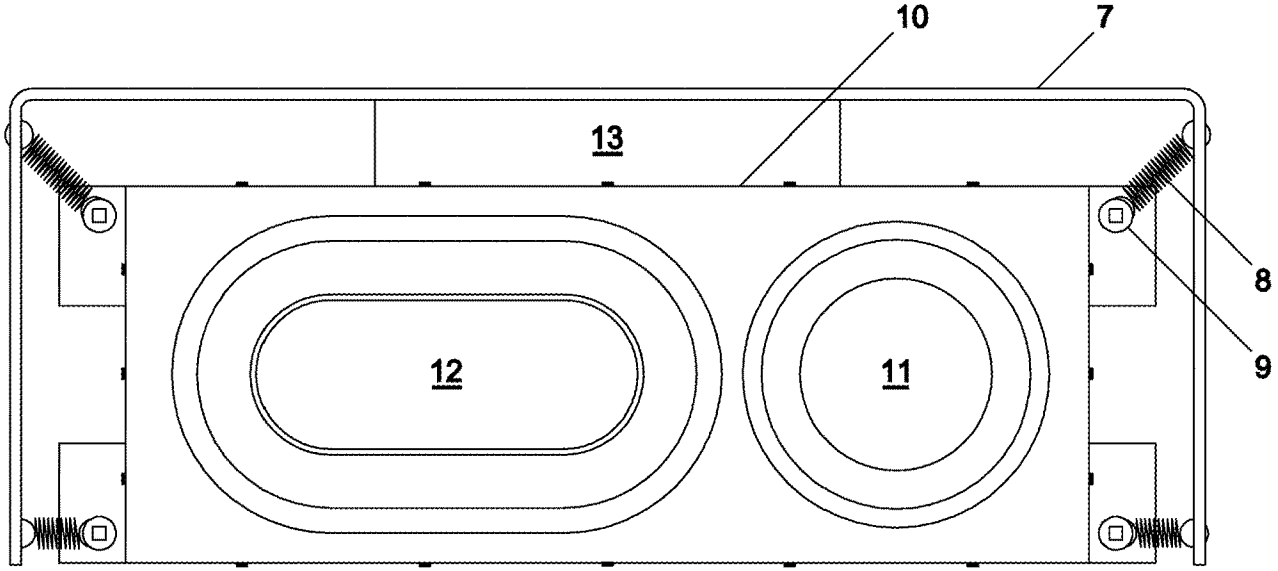
FIG. 3

ELIMINATION OF PARASITIC AUDIO VIBRATIONS USING SPRING MOUNTED SPEAKERS

FIELD OF THE INVENTION

Manufacture of record players and other audio equipment having speaker systems.

BACKGROUND OF THE INVENTION

A speaker driver is a transducer that converts electrical signals into sound. That conversion occurs when a flexible membrane or diaphragm is induced to vibrate at audible frequencies. The vibrations thus produced propagate through the air as sound waves.

Tweeter loudspeakers vibrate most efficiently at high audio frequencies, typically between 2,000 Hz and 20,000 Hz (the upper limit of human hearing). The sound emanating from tweeters is often called "treble," and this type of speaker derives its name from the sounds typically made by birds. Woofer loudspeakers vibrate most efficiently at low audio frequencies, typically between 40 Hz and 500 Hz. The sound emanating from woofers is often called "bass," and this type of speaker derives its name from the sounds typically made by large dogs ("woof").

In a normal speaker driver, the sound waves emanating from the front of the driver are 180 degrees out of phase with the sound waves emanating from the rear. The resulting unwanted sound cancellation is the reason that most speakers are fitted in enclosures. Enclosing a speaker practically isolates the sound emanating from the front of the speaker from that emanating from the rear.

However, even an enclosed speaker system can produce unwanted noise. The problem is far greater with woofers than with tweeters. When the volume of the sound is minimal, the noise may not be noticeable. But, as the volume increases, a buzzing sound appears. The buzzing sound is produced by sympathetic vibration of the speaker enclosure. It can even be worsened when the surface upon which the speaker system rests vibrates sympathetically.

The problem is even more pronounced in vinyl record players (phonographs) that have built-in speakers. A record player has a rotating turntable (upon which the record sits) and a cantilevered tone arm, which further comprises amplification electronics, a needle, and a magnetic or piezoelectric transducer, commonly referred to as a cartridge. Record players built during the last half of the Twentieth Century used diamond-tipped needles. In a record player, the small needle fits inside the groove of the rotating record. Variations in the topography of the groove cause the needle to vibrate. The cartridge translates the vibrations into electrical signals that propagate through the amplification system to the speaker. As the sound is produced, the phonograph chassis vibrates sympathetically. These vibrations are picked up by the cartridge and ultimately transmitted to the speakers. This is the phenomenon of feedback. One solution to the problem is remotely mounting speakers a distance away from the turntable. The problem is less severe in modern CD players, which read a disk with a laser, or in more modern sound systems that do not have moving parts. Indeed, vinyl records have been largely replaced by digital media, and phonographs by CD and MP3 players. However, many music lovers remain loyal listeners to vinyl records, and there is a demand for phonographs with built-in speakers.

The phonograph was invented by Thomas Edison during the last part of the Nineteenth Century. During the early Twentieth Century, wax cylinder recordings were replaced by flat record disks. As sound quality became more important to music listeners, phonograph technology began to evolve. In 1946, U.S. Pat. No. 2,325,807 was issued to I. L. Stephan for a phonograph mounting that included a floating base supported by a plurality of conical compression springs. Stephan's purpose was to isolate his turntable from vibrations of the phonograph chassis. In 1956, U.S. Pat. No. 2,775,309 was issued to Villchur for a high quality speaker system. Loudspeakers produced according to Villchur's patent were widely sold by Acoustic Research, a Cambridge, Mass. company. These AR speaker systems used a different support for their diaphragms and used the elasticity of air within an enclosure of 1.7 cubic feet to provide the restoring force to the woofer cone. Acoustic Research referred to this technology as "air suspension." While AR speaker systems yielded higher quality bass reproduction, these speakers needed to be remotely located from the record turntable.

In 1967, U.S. Pat. No. 3,342,498 was issued to R. G. Eberhardt for a portable phonograph having integral speakers. Eberhardt placed his speakers in a five-sided speaker assembly that was mounted in the phonograph by a plurality of coiled compression springs. His objective was to avoid acoustic feedback by damping the vibration of the speakers from the turntable. While this may have provided some improvement in sound quality, it was largely unsuccessful for three reasons. First, the speaker assembly was open-ended, thus failing to isolate the low frequency waves emanating from the front of the speaker from those emanating from the rear. Second, although Eberhardt claimed otherwise, acoustic vibrations were transmitted to the phonograph chassis because the use of bulky components necessitated supportively heavy coiled compression springs. Conduction of sound waves through the chassis has a greater tendency to produce unwanted feedback than sound convection through the air. Third, although the speaker assembly itself became a bass-reinforcing resonator, it did so at the expense of distortion performance.

In 2016, U.S. Pat. No. 9,473,853 was issued to H. M. Huang for a compact, lightweight, and airtight speaker module. Placing Huang's speakers in a small volume sealed container forces air pressure onto the speaker cone, thus inhibiting vibration. The air in the container acts like a spring. When the sealed volume is small, the air has less elasticity. However, the container includes a passive radiator, which serves to increase compliance of the container interior, thereby reducing the size requirement. Thus, Huang's speaker module produces high quality bass and treble sound. However, it does not solve the vibration problem in a record player. If this speaker module is directly mounted to the phonograph chassis, sound waves conduct to the tone arm, and this conduction creates acoustic vibration and feedback.

There has been a long-felt need among vinyl record aficionados for a portable record player or phonograph with built-in speakers, which produces high quality sound without distortion.

SUMMARY OF THE INVENTION

The solution provided by the Present Invention is twofold. First, the speakers are mounted in a substantially airtight enclosure. Second, the substantially airtight enclosure is suspended within the sound system chassis using elastic members in tension. A typical elastic member is an extension spring. The Present invention applies to a wide variety of sound systems, such as Bluetooth® speakers, architectural speakers, intercoms, automotive sound systems, guitar and bass amplifiers, multimedia speakers, musical instruments, near-field monitors, public address (PA) systems, stage monitors, studio monitors, and phonographs. In a phonograph, the elastic suspension almost completely isolates vibrations of the speaker enclosure from the phonograph chassis, thereby drastically reducing sympathetic vibration and feedback, and accommodating new depths of bass extension.

BRIEF DESCRIPTION OF THE DRAWINGS

FIG. 2 shows the extension spring mounting of the substantially airtight speaker enclosure of the Present Invention. FIG. 2A shows a front elevation. FIG. 2B shows a side elevation.

FIG. 3 shows the Present Invention of FIG. 2, where the chassis has a mechanical stop that limits movement of the enclosure for protection against overextending the extension springs. FIG. 3A shows a front elevation. FIG. 3B shows a side elevation.

DETAILED DESCRIPTION OF THE INVENTION

The sound emanating from the speakers in a phonograph or record player is generated by three different phenomena:

1. sound waves emanating from the speaker system via air convection;
2. sound waves emanating from the chassis or speaker enclosure via conduction through the material that forms the chassis or enclosure; and
3. sound waves emanating from the speaker system caused by feedback via the tone arm.

High quality sound in a record player or phonograph should only be produced by the first instance (above). The second and third instances tend to degrade the sound quality.

Figure 1:
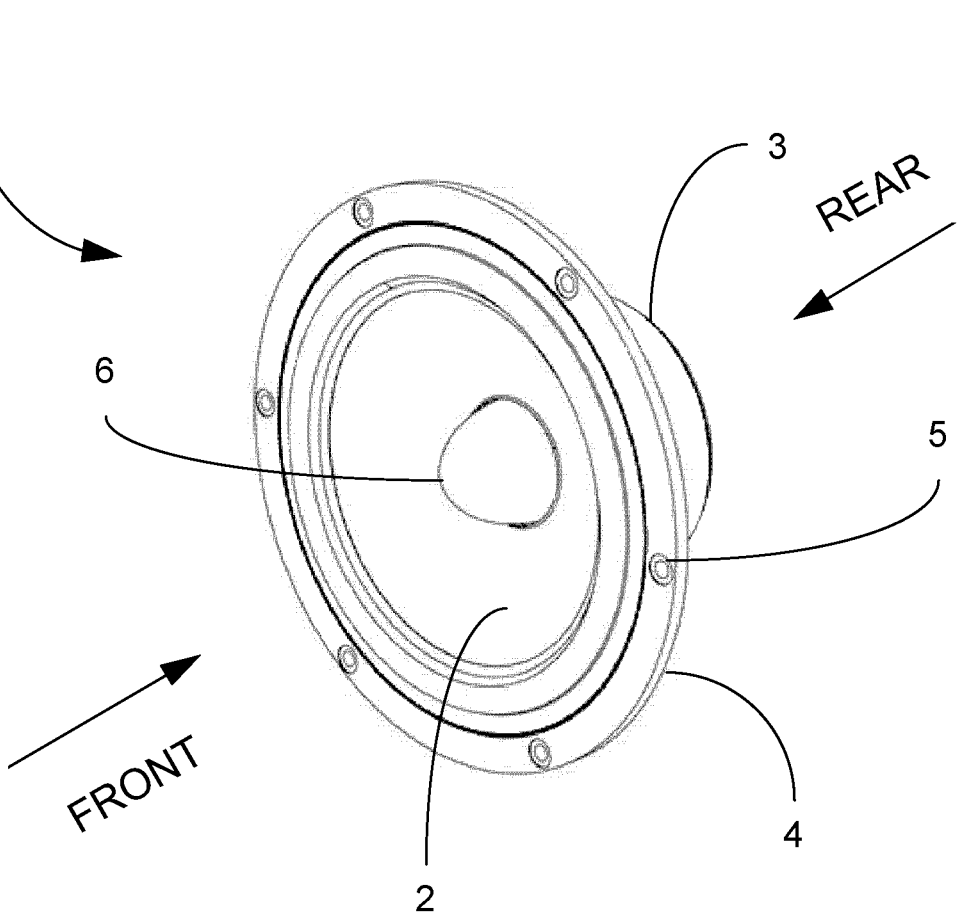
PRIOR ART FIG. 1
FIG. 1 shows an isometric view of a typical prior art speaker driver.

FIG. 1 is an isometric view of a commonly used speaker driver, 1. Sound is created by vibration of a diaphragm, 2, at the front of the driver. Diaphragm, 2, is held in place by a spider structure (not shown), which is covered by basket, 3. The entire structure is held in place via a mounting flange, 4, which has holes, 5, through which the driver is mounted in an enclosure (not shown). In the center of the diaphragm is a cap, 6, covering the voice coil (not shown), which is the coil of wire attached to the apex of a speaker cone. It provides the motive force to the cone by the reaction of a magnetic field to the current passing through it via the magnet frame. The cap, 6, acts as a "phase plug," which serves to isolate the out-of-phase waves. The speaker is labeled FRONT pointing to the diaphragm, 2, and REAR pointing to the magnet frame. The sound emanating toward the FRONT is 180 degrees out of phase with the sound emanating toward the REAR. Thus, the sound waves tend to cancel each other. There is almost no cancellation of high frequency treble sound waves, but it is very noticeable in the bass range. When the speaker is mounted, the enclosure acts as a baffle to isolate these out-of-phase sound waves. Thus, the listener should theoretically only hear sound emanating toward the FRONT.

Sound emanating from an enclosed speaker system travels through the air via a convection process. However, the enclosure itself receives sound vibrations directly from the mounted speaker via conduction. The speaker's vibration is transferred to the enclosure construction material, which may be wood, plastic, or metal. Low frequency vibration also sends sound waves into the air, thus producing cancellation when mixing with the sound waves emanating toward the FRONT.

In order to eliminate conducted sound and feedback, three things must happen. First, the speaker system must be enclosed. Second, the speaker system and its enclosure must be mounted in such a manner as to inhibit sound conduction in the chassis or speaker system enclosure. This can be accomplished by suspending the speaker system enclosure with elastic members in tension, such as extension springs or elastic cords, where the elastic members have sufficient resiliency. Third, the tensile elastic members should be just massive enough to reliably support the speaker enclosure, but not significantly greater.

A common type of tensile elastic member is an extension spring. An extension spring is a coil of wire that expands under tension. It is functionally the opposite of a compression spring. Coiling wire is not the only way to make a tensile elastic member. Elastic cord, like that of a common rubber band, works well as a tensile elastic member. However, rubber deteriorates over time.

Enclosing the speaker system prevents phase cancellation between sound waves emanating from the front of the speakers and those emanating from the rear. Mounting the speaker system using tensile elastic members provides the maximum sound conduction damping effect. The prior art technology that used coiled compression springs induced pressure on the chassis, thereby enhancing the sound wave conduction, whereas the use of thin extension springs tends to minimize the conduction effect to the chassis material.

FIG. 2 shows the solution to the problem afforded by the Present Invention. The speakers, 11 and 12, are enclosed in a speaker enclosure, 10, such that the speaker diaphragms are exposed. The speaker enclosure, 10, encloses at least one speaker or a plurality of speakers. The speaker diaphragms are exposed on only one surface, i.e., the front of the enclosure, 10. One end of each of four extension springs, 8, is attached to the speaker enclosure, 10, by screws, 9. The second end of each of the four extension springs, 8, is mounted to the chassis, 7.

In the drawing, two speakers, 11 and 12, are shown. There may be a larger plurality of speakers, but there must be at least one speaker. Of the two speakers shown, one may be a woofer and the other a tweeter. However, this type of mounting in the Present Invention is unnecessary for tweeters. It is only necessary for woofers. As discussed earlier, there is almost no cancellation of treble sound waves, but it is very noticeable in the bass range.

In FIG. 2, one speaker, 11, can be an active speaker, and the other, 12, a passive radiator. A passive radiator is just like a regular speaker, but without electromagnetic parts such as a voice coil and magnet. When a regular speaker (active driver) moves air back and forth inside a speaker enclosure, the diaphragm of a passive radiator moves in reaction, as though it were a regular speaker. The passive radiator helps the active driver make more bass with less diaphragm movement and a much smaller speaker enclosure.

The chassis looks like an independent component in the drawings, and indeed, it may be. For the sake of cost reduction, there are many applications where the chassis would not be a separate component unto itself. In an exemplary embodiment, the Present Invention can be practiced in a Bluetooth® speaker. Here, the cabinet of the Bluetooth® speaker acts as the chassis of the Present Invention. To take cost reduction to an extreme, the tensile elastic members themselves may be cast as elastic strands in the same instance as both the Bluetooth® speaker cabinet and the speaker enclosure of the Present Invention. The chassis, tensile elastic members, and speaker enclosure would be produced as one in a single manufacturing step.

FIG. 3 shows the solution to the problem afforded by the Present Invention depicted in FIG. 2, where the chassis, 7, further includes a mechanical stop, 13, that acts to limit movement of the enclosure for protection against overextending the elastic members. This mechanical stop is highly beneficial as it prevents damage to the unit during shipping.

Figure 4:
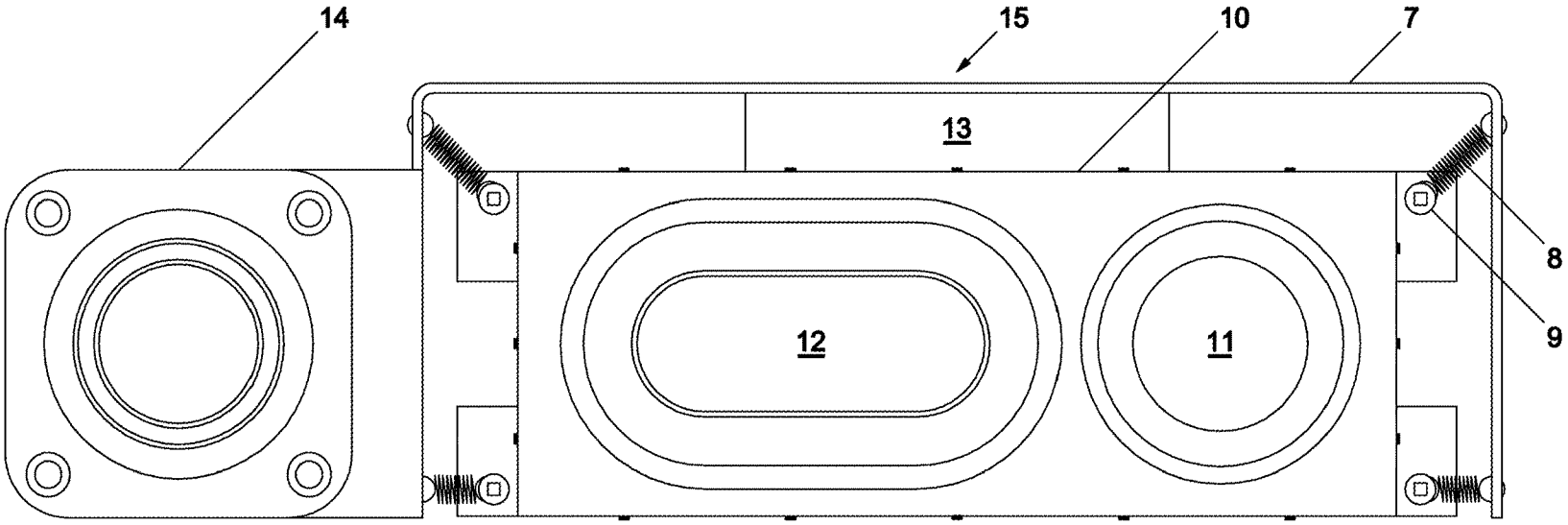
FIG. 4 shows the Present Invention of FIG. 3 with a tweeter rigidly attached to the chassis.

FIG. 4 shows the solution to the problem afforded by the Present Invention depicted in FIG. 3, where a tweeter, 14, not in the enclosure, is mounted directly to the chassis, 7. Here, the entire assembly, including the tweeter, is labeled 15. Although the tensile elastic suspension of the Present Invention can be applied to tweeters, there is very little benefit in doing so. The high frequencies produced by tweeters are unlikely to cause the troublesome sympathetic vibrations experienced with woofer or midrange drivers. For this reason, the drawing shows the tweeter, 14, rigidly attached to the chassis, 7, as opposed to being suspended.

Figure 5:
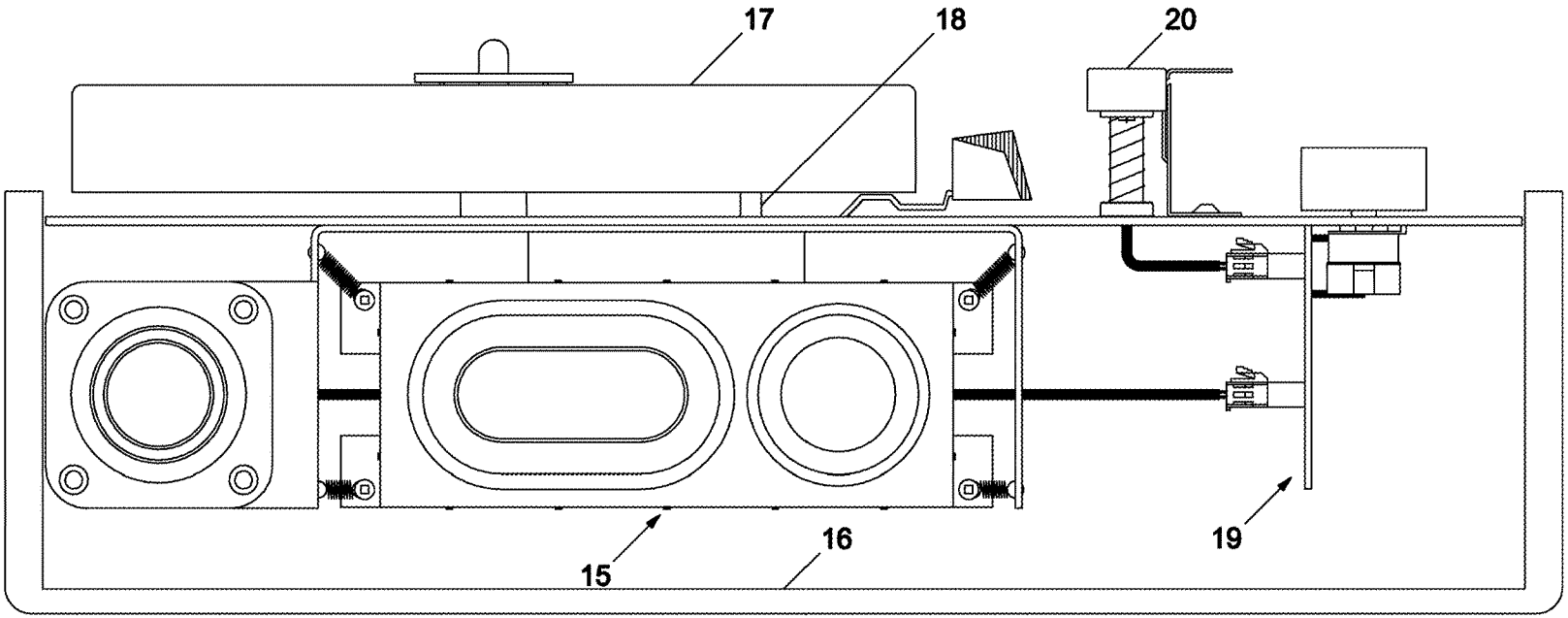
FIG. 5 shows the interior of a record player of the Present Invention with the mounted speaker system.

FIG. 5 shows the interior of the record player mechanism (phonograph) of the Present Invention with the mounted speaker system, 15. The entire enclosure and chassis, 15, including the external tweeter, fits inside the record player. A recording (e.g., a vinyl record disk) would sit atop the turntable, 17, which rotates. The record player platform is rigidly mounted within a phonograph chassis, 16. Only the shaft, 18, of the motor that causes the turntable to rotate is shown in the drawing. Also mounted below the platform is an amplifier, 19, having a knob (atop the platform) that controls the sound volume. Mounted atop the platform is a cantilevered tone arm, 20, which contains a cartridge having a magnetic or piezoelectric module capable of converting mechanical pressure to electrical signals. At the bottom of the cartridge is a stylus (normally diamond tipped) that is small enough to allow insertion into a narrow groove of the prerecorded disk (not shown) that would rest atop the turntable. The grooves of the prerecorded disk have contours created in the disk by the recording process. The grooves form a spiral on the disk, thus providing a continuous path for the stylus to traverse while the disk rotates beneath it. Mechanical movement of the stylus due to the groove contours is transferred to the magnetic or piezoelectric module of the cartridge, which converts movement of the stylus to electrical signals. These signals are electronically transferred to the amplifier and then to the speakers, thereby producing audible sound. In the drawing, the tone arm, 20, is shown in its resting position. The tone arm is spring mounted to the platform. It can be rotated vertically, and it can rotate around its axis horizontally to positions above the turntable. Wires connecting the tone arm to the amplifier and connecting the amplifier to the speaker system are shown in the drawing.

I claim:

1. A method for minimizing sympathetic vibrations in a sound system comprising one or more speaker drivers mounted within a chassis, said method comprising:

a) enclosing the one or more speaker drivers in a stand-alone substantially airtight enclosure; and b) resiliently suspending the stand-alone enclosure within a chassis that is separate from the stand-alone enclosure using a plurality of elastic members in tension, wherein:

i) the plurality of elastic members in tension provides sufficient mechanical support to the enclosure to enable it to remain suspended;

ii) the enclosure does not significantly conduct vibration to the chassis through direct contact; and iii) each of the plurality of elastic members in tension has sufficiently high resiliency to negate the transfer of vibration from the enclosure to the chassis, whereby:

sympathetic vibration within the chassis from sound produced by the one or more speaker drivers in the enclosure is minimized.

2. The method of claim 1 wherein each of the plurality of elastic members in tension is an extension spring.

3. The method of claim 1 wherein the one or more speaker drivers is a single speaker driver.

4. The method of claim 1 wherein the one or more speaker drivers is a plurality of speaker drivers.

5. The method of claim 1 wherein the chassis is a stand-alone module.

6. The method of claim 1 wherein the chassis is an integral part of a sound producing system.

7. The method of claim 6 wherein the sound producing system is a record player, further comprising a turntable and a tone arm, which further comprises a stylus connected to a magnetic or piezoelectric cartridge.

8. The method of claim 1 wherein the chassis further includes a mechanical stop that acts to limit movement of the enclosure for protection against overextending the elastic members in tension.

9. The method of claim 1 wherein the one or more speaker drivers comprises an active speaker driver and a passive radiator.

10. The method of claim 1 wherein a tweeter is rigidly attached to the chassis.

11. A sound producing system, which minimizes sympathetic vibration, comprising:

a) one or more speaker drivers;

b) a stand-alone a substantially airtight enclosure into which the one or more speaker drivers are mounted;

c) a chassis that is separate from the stand-alone enclosure; and d) a plurality of elastic members in tension, wherein:

i) each or the plurality of elastic members in tension is attached to the stand-alone enclosure;

ii) each of the plurality of elastic members in tension is attached to the chassis;

iii) the stand-alone enclosure does not significantly conduct vibration to the chassis through direct contact; and iv) the elastic members in tension have sufficiently high resiliency so as to negate the transfer of vibration from the stand-alone enclosure to the chassis;

whereby:

sympathetic vibration within the chassis from sound produced by the one or more speaker drivers in the stand-alone enclosure is minimized.

12. The sound producing system of claim 11 wherein each of the plurality of elastic members in tension is an extension spring.

13. The sound producing system of claim 11 wherein the one or more speaker drivers is a single speaker driver.

14. The sound producing system of claim 11 wherein the one or more speaker drivers is a plurality of speaker drivers.

15. The sound producing system of claim 11 wherein the chassis is a standalone module.

16. The sound producing system of claim 11 wherein the chassis is an integral part.

17. The sound producing system of claim 16 wherein the sound system is a record player, further comprising a turntable and a tone arm, which further comprises a stylus connected to a magnetic or piezoelectric cartridge.

18. The sound producing system of claim 11 wherein the chassis further comprises a mechanical stop that acts to limit movement of the standalone enclosure for protection against overextending the elastic members in tension.

19. The sound producing system of claim 11 wherein the one or more speaker drivers comprises an active speaker driver and a passive radiator.

20. The sound producing system of claim 11 further comprising a tweeter that is rigidly connected to the chassis.

21. A record player that electro-mechanically produces sound, with minimized sympathetic vibration, from prerecorded disk, having grooves with contours produced by a recording process, said record player comprising:

a) a chassis;

b) a turntable upon which the prerecorded disk is securely seated, wherein the turntable rotates the prerecorded disk in its own plane;

c) a motor capable of rotating the turntable;

d) an amplifier and associated electronics;

e) a cantilevered tone arm further comprising;

i) a cartridge comprising a magnetic or piezoelectric module capable of converting mechanical pressure to electrical signals;

ii) a stylus connected to the cartridge, wherein said stylus is capable of insertion into a groove in the prerecorded disk;

iii) an electrical connection to the amplifier;

f) one or more speaker drivers;

g) a substantially airtight enclosure into which the one or more speaker drivers are affixed;

h) a plurality of elastic members in tension, wherein:

i) each or the plurality of elastic members in tension is attached to the enclosure;

ii) each of the plurality of elastic members in tension is attached to the chassis;

iii) the enclosure does not significantly conduct vibration to the chassis through direct contact; and iv) the elastic members in tension have sufficiently high resiliency to negate the transfer of vibration from the enclosure to the chassis;

whereby:

sympathetic vibration within the chassis from sound produced by the one or more speaker drivers in the enclosure is minimized.

22. The record player of claim 21 wherein each of the plurality of elastic members in tension is an extension spring.

23. The record player of claim 21 wherein the one or more speaker drivers is a single speaker driver.

24. The record player of claim 21 wherein the one or more speaker drivers is a plurality of speaker drivers.

25. The record player of claim 21 wherein the chassis further comprises a mechanical stop that acts to limit movement of the enclosure for protection against overextending the elastic members in tension.

26. The record player of claim 21 wherein the one or more speaker drivers comprises an active speaker driver and a passive radiator.

27. The record player of claim 21 further comprising a tweeter that is rigidly attached to the chassis.

28. The record player of claim 21 wherein the chassis is a stand-alone component.

29. The record player of claim 21 wherein the chassis is a structurally integral part of the record player.

* * * * *